US009845967B2

(12) United States Patent
Deng

(10) Patent No.: US 9,845,967 B2
(45) Date of Patent: Dec. 19, 2017

(54) INTELLIGENT AIR CONDITIONER SOCKET WITH ABNORMALITY ALARM

(71) Applicant: Staba Electric Co., Ltd, Zhongshan, Guangdong Province (CN)

(72) Inventor: Yuhua Deng, Zhongshan (CN)

(73) Assignee: Staba Electric Co., Ltd., Zhongshan (CN)

( * ) Notice: Subject to any disclaimer, the term of this patent is extended or adjusted under 35 U.S.C. 154(b) by 417 days.

(21) Appl. No.: 14/612,910

(22) Filed: Feb. 3, 2015

(65) Prior Publication Data

US 2016/0123623 A1 May 5, 2016

(30) Foreign Application Priority Data

Oct. 29, 2014 (CN) ..... 2014 1 0597463

(51) Int. Cl.
*G06F 11/30* (2006.01)
*F24F 11/00* (2006.01)
*G21C 17/00* (2006.01)

(52) U.S. Cl.
CPC ..... *F24F 11/0086* (2013.01); *F24F 11/0012* (2013.01); *F24F 2011/0013* (2013.01); *F24F 2011/0052* (2013.01); *F24F 2011/0091* (2013.01); *F24F 2011/0094* (2013.01)

(58) Field of Classification Search
CPC ..... F24F 11/0086
See application file for complete search history.

(56) References Cited

U.S. PATENT DOCUMENTS

2006/0271214 A1* 11/2006 Brown ..... A61B 5/0002 700/90
2012/0165993 A1* 6/2012 Whitehouse ..... G05D 23/1904 700/278

* cited by examiner

*Primary Examiner* — Phuong Huynh
(74) *Attorney, Agent, or Firm* — Tucker Ellis LLP; Heather M. Barnes

(57) ABSTRACT

An intelligent with abnormality alarm which may comprise a housing, jacks in the surface of the housing and a conductive component arranged within the housing, wherein the housing is internally provided with a single chip processor as well as a current detection module, a voltage detection module, an outdoor temperature detection module, an indoor temperature detection module, a display module and a power supply module which are electrically connected with the single chip processor respectively. The power supply module is connected with the display module to power it. The socket may be used to carry out a real-time monitoring without making modification to the software and hardware. After applying the air conditioner socket of the present invention, the user may replace the socket of the air conditioner of a corresponding model him or her, i.e., the monitoring of an installed air conditioner may be accomplished with a minimum cost.

6 Claims, 7 Drawing Sheets

INTELLIGENT AIR CONDITIONER SOCKET WITH ABNORMALITY ALARM

This application claims priority to Chinese Application No. 201410597463.0 filed on Oct. 29, 2014, which is incorporated by reference in its entirety.

FIELD OF THE INVENTION

The present invention relates to a socket, in particular to an intelligent air conditioner socket with abnormality alarm.

BACKGROUND OF THE INVENTION

Generally, an air conditioner provides only external motor temperature protection prompts, room temperature display and the like, but no correct feedback information about substantive performances of the air conditioner is provided to users for communication. The users have no way of learning a series of information like whether the air conditioner is in a normal refrigeration state, and whether the use environment is proper, etc. The users just start power-on settings and use the air conditioner; while the air conditioner just operates until a compressor stops operating after a set temperature is reached. After a long time use, the users do not know whether the performance of the air conditioner degrades.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As the types of the air conditioner are limited, various parameters of a single air conditioner are unique. How to monitor the air conditioner and implement intelligent abnormality alarm with regard to the air conditioner having known parameters without changing hardware and software settings is a problem to be solved by the present invention. When the air conditioner is in use, a socket is needed to provide access to a power supply, and the current and voltage accessed through the socket is the actual input of the air conditioner. This is where the concept of the invention comes in.

To overcome the above technical problem, an object of the invention is to provide an intelligent air conditioner socket having abnormality alarm.

A technical scheme adopted by the present invention may be described as follows.

An intelligent air conditioner socket with abnormality alarm may comprise a housing, jacks in the surface of the housing and a conductive component arranged within the housing.

Arranged within the housing may be a single-chip processor as well as a current detection module, a voltage detection module, an outdoor temperature detection module, an indoor temperature detection module, a display module and a power supply module, which may be electrically connected with the single-chip processor respectively, wherein the power supply module may be connected with the display module to power it.

The current detection module and the voltage detection module may be used for detecting a sampled current and a sampled voltage output to the air conditioner after the power network may be connected to the socket respectively, wherein the sampled current and the sampled voltage may be fed back to the single-chip processor respectively through an operational amplifier circuit.

The outdoor temperature detection module and the indoor temperature detection module may be used for detecting outdoor and indoor temperature signals and feeding the signals back to the single-chip processor.

As a control and processing core, the single-chip processor may conduct voltage abnormality detection, current abnormality detection and temperature abnormality detection respectively using the feedback signals.

The voltage abnormality detection may comprise comparing a difference between the sampled voltage and a rated voltage with a preset normal voltage difference, if the difference exceeds the preset normal voltage difference, an input voltage of the air conditioner may be determined to be overvoltage or undervoltage, and a voltage abnormality alarm signal may be output.

The current abnormality detection may comprise comparing a difference between the sampled current and a rated current with a preset normal current difference, if the current difference exceeds the preset normal current difference, an input current of the air conditioner may be determined to be overcurrent or undercurrent, and a current abnormality alarm signal may be output.

The temperature abnormality detection may comprise determining whether a predetermined temperature reduction magnitude is within the range of an actual temperature reduction magnitude*(−120%, +120%) within a time period of $T \epsilon T_0 \sim Tm$, and if not, an abnormality alarm signal may be output; wherein the actual temperature reduction magnitude=$F(Tm)-F(T_0)$, $F(T_0)$ is an initial indoor temperature, and F(Tm) is the indoor temperature at Tm; and the predetermined temperature reduction magnitude=$\epsilon T_0 \sim Tm$ [voltage T(v)*current T(a)]*nominal energy efficiency ratio (B)/nominal space area (A)*coefficient of performance R(T)*nominal power factor C, wherein the voltage T(v) and the current T(a) are the sampled voltage and sampled current detected at time T respectively, and the coefficient of performance R(T) is the corresponding coefficient of performance of the outdoor temperature and the indoor temperature at time T.

The display module may be used for displaying the current temperature, power and abnormality alarm prompts output by the single-chip processor.

Further, the single-chip processor may prestore a table of values of coefficient of performance at different outdoor temperatures and indoor temperatures directly or indirectly, and may read the value of the coefficient of performance R(T) corresponding to the outdoor temperature and the indoor temperature at time T from the table.

Further, the power supply module may be a switching power supply which may comprise a rectifier IC, a transformer and an isolation optocoupler.

Further, the current detection module may use constantan wire as a current detection device.

Further, the display module may include a display IC and a digital display screen.

Further, the outdoor temperature detection module and the indoor temperature detection module may use an external thermistor as a temperature sensor to detect the outdoor and indoor temperatures, respectively.

By way of nonlimiting example, beneficial effects of the present invention may be described as follows.

In the present invention, a socket for the air conditioner may be used to carry out a real-time monitoring without making modification to the software and hardware, and the cost of socket modification is much lower than the cost of modifying the air conditioner itself. After applying the air conditioner socket of the present invention, the user may replace the socket of the air conditioner of a corresponding model him or her, that is, the monitoring of an installed air conditioner may be accomplished with a minimum cost.

The socket of the present invention has a wide monitoring range, for it may have a voltage detection module for detecting whether the input is overvoltage or undervoltage, a current detection module for detecting whether the current is excessive, and a display module providing a timely prompt function, thereby effectively ensuring that the air conditioner will not be in an abnormal operating state for a long time, allowing the air conditioner to reach a nominal life.

In addition to the current and voltage detection, the temperature detection may be added, which is not just a simple indication of room temperature, but may comprehensively introduce the sampled current, the sampled voltage, the indoor temperature and the outdoor temperature into factors influencing the predetermined temperature reduction magnitude. Besides, a software algorithm may be combined with a formula for calculating the predetermined temperature reduction magnitude to obtain a true and valid predetermined temperature reduction magnitude which may then be compared to the actual temperature reduction magnitude to determine whether the air conditioner operates normally. With such a detection mode, the absolute, true and valid indoor and outdoor temperature factors may be involved in the calculation when the current detection and voltage detection are unable to monitor the operation of the air conditioner genuinely, thereby allowing possible unconventional detection faults such as refrigerating system dust, too little refrigerant, whether there being a mismatch between the use space and a nominal space, unreasonable installation of pipes to be identified.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF DRAWINGS

What is disclosed herein may take physical form in certain parts and arrangement of parts, and will be described in detail in this specification and illustrated in the accompanying drawings which form a part hereof and wherein.

DETAILED DESCRIPTION OF THE EMBODIMENTS

Figure 1:
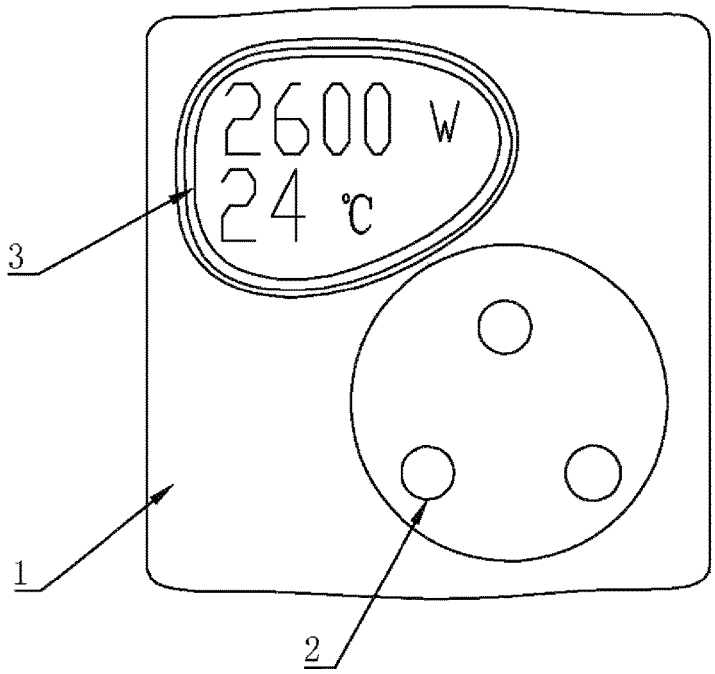
FIG. 1 is a front view of an air conditioner socket of the present invention.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices may be shown in block diagram form in order to facilitate describing the claimed subject matter.

With reference to FIG. 1, an intelligent air conditioner socket with abnormality alarm may comprise a housing 1, jacks 2 in a surface of the housing 1 and a conductive component (not shown), and the surface of the housing 1 may be further provided with a digital display screen 3.

Figure 2:
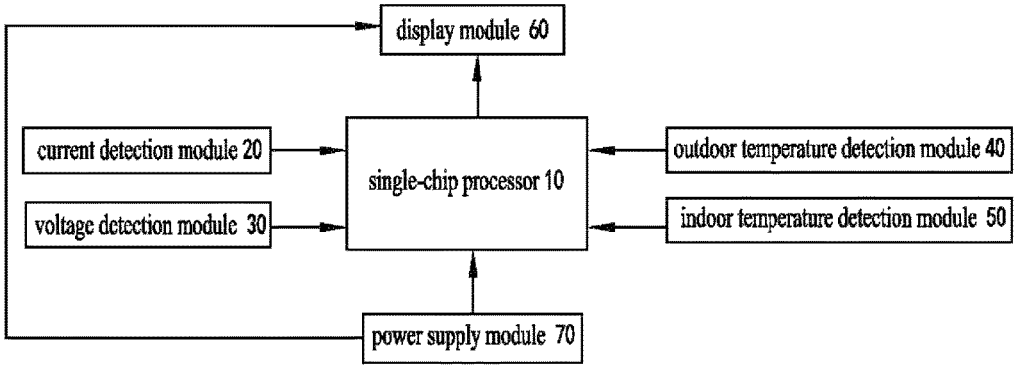
FIG. 2 is a functional block diagram of an internal circuitry of the air conditioner socket of the present invention.

As shown in FIG. 2, the air conditioner socket of the present invention may be internally provided with a single-chip processor 10 as well as a current detection module 20, a voltage detection module 30, an outdoor temperature detection module 40, an indoor temperature detection module 50, a display module 60 and a power supply module 70 which may be electrically connected with the single-chip processor 10, wherein the power supply module 70 is connected with the display module 60 to power it.

The current detection module 20 and the voltage detection module 30 may be used for detecting a sampled current and a sampled voltage output to the air conditioner after the power network is connected to the socket respectively, wherein the sampled current and the sampled voltage may be fed back to the single-chip processor 10 respectively through an operational amplifier circuit.

The outdoor temperature detection module 40 and the indoor temperature detection module 50 may be used for detecting outdoor and indoor temperature signals and feeding the signals back to the single-chip processor 10.

As a control and processing core, the single-chip processor 10 may conduct voltage abnormality detection, current abnormality detection and temperature abnormality detection respectively use the feedback signals.

The display module 60 may be used for displaying the current temperature, power and abnormality alarm prompts output by the single-chip processor 10.

Figure 3:
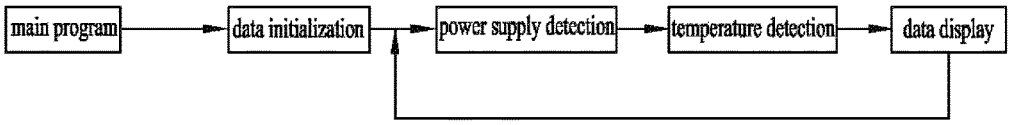
FIG. 3 is a flow chart of a main program of the present invention.

FIG. 3 is a main process of the present invention which sequentially may comprise starting of a main program, data initialization, power supply detection (current and voltage detection), temperature detection, data display and then returning to power supply detection.

Figure 4:
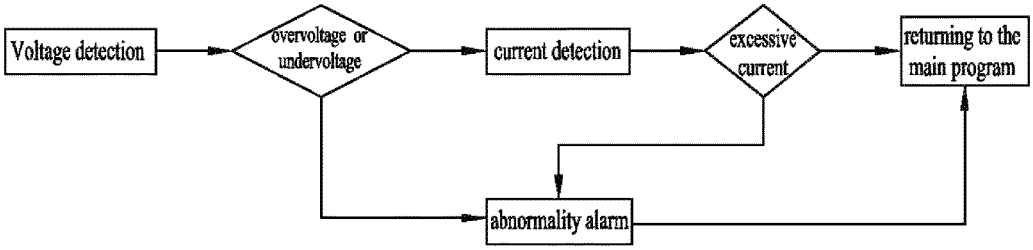
FIG. 4 is a flow chart of current and voltage detection of the present invention.

FIG. 4 shows a specific flow chart of the power supply detection. The voltage detection may be performed first to detect whether there is an overvoltage or undervoltage by comparing a difference between the sampled voltage feedback and a rated voltage with a preset normal voltage difference. If the difference exceeds the preset normal voltage difference, an abnormality alarm may be given by the display module 60, otherwise the process may proceed to the current detection. The current detection may be mainly used for detecting whether the current is excessive by comparing a difference between the sampled current feedback and a rated current with a preset normal current difference. If the difference exceeds the preset normal current difference, the current is excessive and an abnormality alarm may be given by the display module 60, otherwise the process may proceed to the main program.

By using the voltage detection module 30 to detect whether the input is overvoltage or undervoltage, using the current detection module 20 to detect whether the current is excessive, and using the display module 60 to provide a timely prompt, that the air conditioner may not be in an abnormal operating state for a long time may be effectively guaranteed, thereby allowing the air conditioner to reach a nominal life.

The current and voltage detection may be applicable to monitoring of the air conditioner operation when power network fluctuation or a fault occurs, but may not truly monitor the operation of the air conditioner for possible unconventional detection faults such as refrigerating system dust, too little refrigerant, whether there being a mismatch between the use space and a nominal space, unreasonable installation of pipes, etc.

Figure 5:
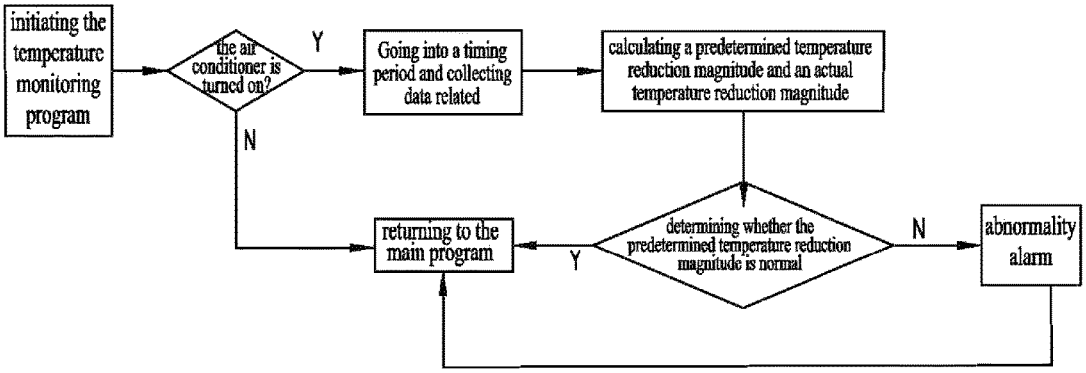
FIG. 5 is a flow chart of temperature detection of the present invention.

FIG. 5 shows a flow chart of the temperature detection of the present invention, which may comprise: 1) starting from initiating a temperature monitoring program; 2) detecting whether the air conditioner is turned on; 3) if yes, going into a timing period, i.e., detecting the sampled current, the sampled voltage, the indoor temperature and the outdoor temperature within a time period of $T \epsilon T0 \sim Tm$, and if no, returning to the main program; 4) calculating a predetermined temperature reduction magnitude and an actual temperature reduction magnitude; and 5) determining whether the predetermined temperature reduction magnitude is within the range of the actual temperature reduction magnitude*(−120%, +120%), if no, outputting an abnormality alarm signal, and if yes, returning to the main program.

Wherein the actual temperature reduction magnitude=$F(Tm)-F(T_0)$, $F(T_0)$ is an initial indoor temperature, and F(Tm) is the indoor temperature at Tm; and the predetermined temperature reduction magnitude=$\Sigma T_0 \sim Tm$ [voltage T(v)*current T(a)]*nominal energy efficiency ratio (B)/nominal space area (A)*coefficient of performance R(T)*nominal power factor C, wherein the voltage T(v) and the current T(a) are the sampled voltage and sampled current detected at time T respectively, and the coefficient of performance R(T) is the corresponding coefficient of performance of the outdoor temperature and the indoor temperature at time T. With regard to the acquisition of refrigerating parameters, the single-chip processor 10 may prestore a table of values of coefficient of performance at different outdoor temperatures and indoor temperatures directly or indirectly, and may read the value of the coefficient of performance R(T) corresponding to the outdoor temperature and the indoor temperature at time T from the table.

Figure 6:
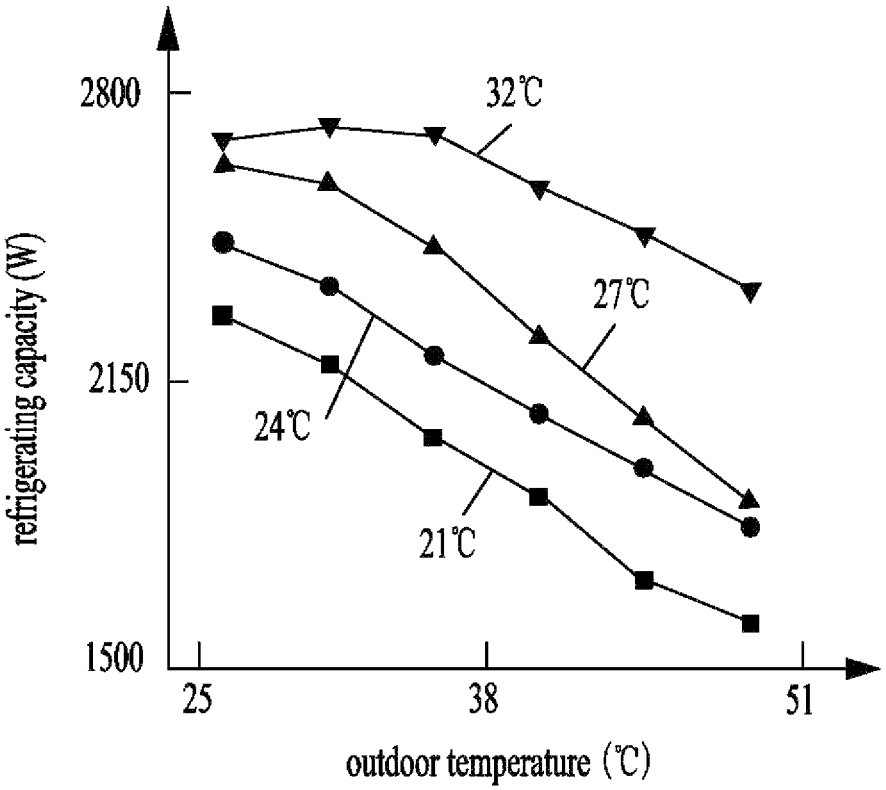
FIG. 6 is a graph of refrigerating capacity as a function of outdoor temperature.
Figure 7:
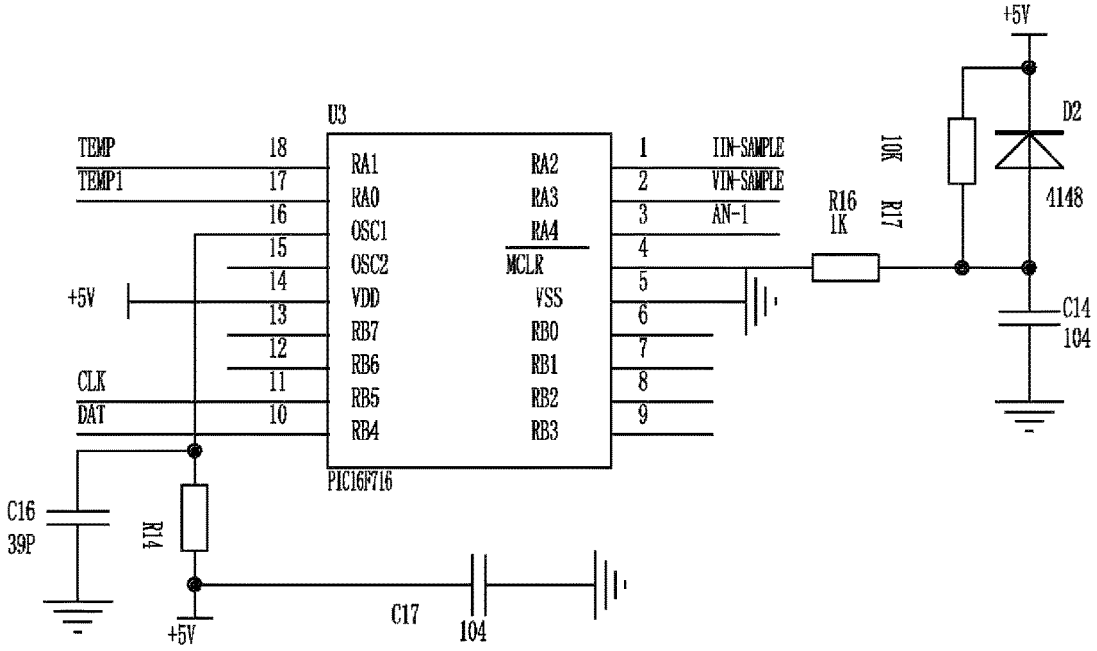
FIG. 7 is a circuit diagram of a single-chip processor.
Figure 8:
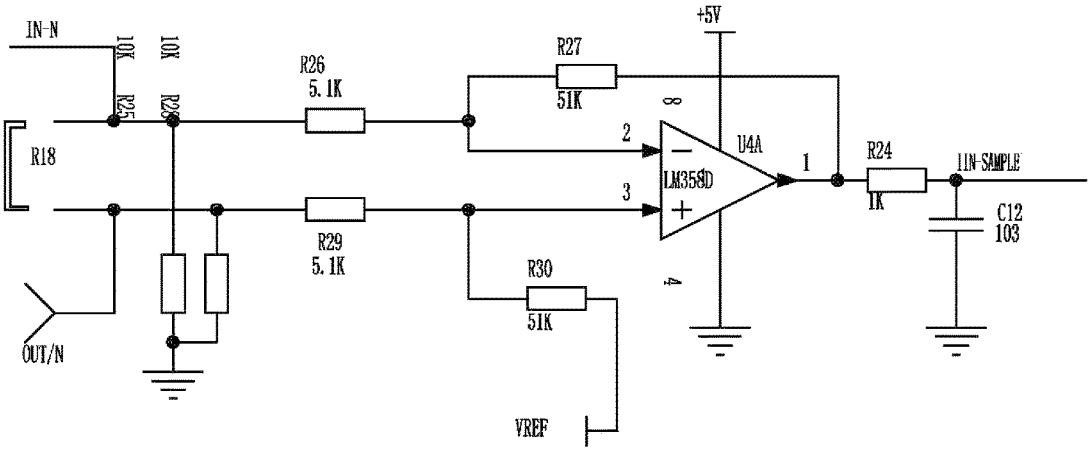
FIG. 8 is a circuit diagram of a current detection module.
Figure 9:
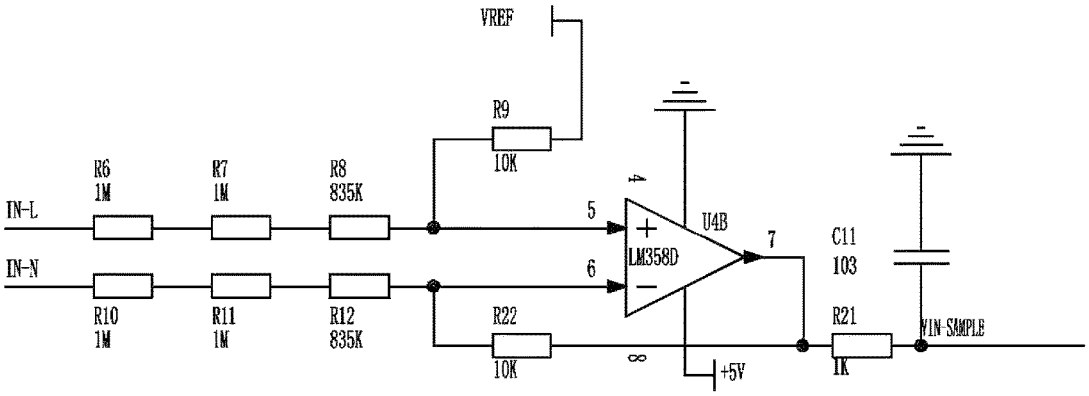
FIG. 9 is a circuit diagram of a voltage detection module.
Figure 10:
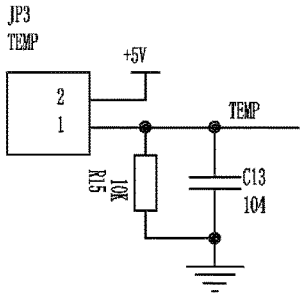
FIG. 10 is a circuit diagram of an outdoor temperature detection module.
Figure 11:
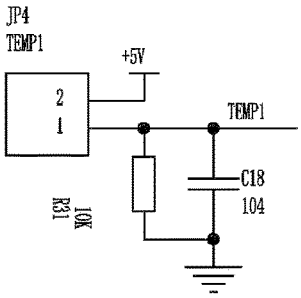
FIG. 11 is a circuit diagram of an indoor temperature detection module.
Figure 12:
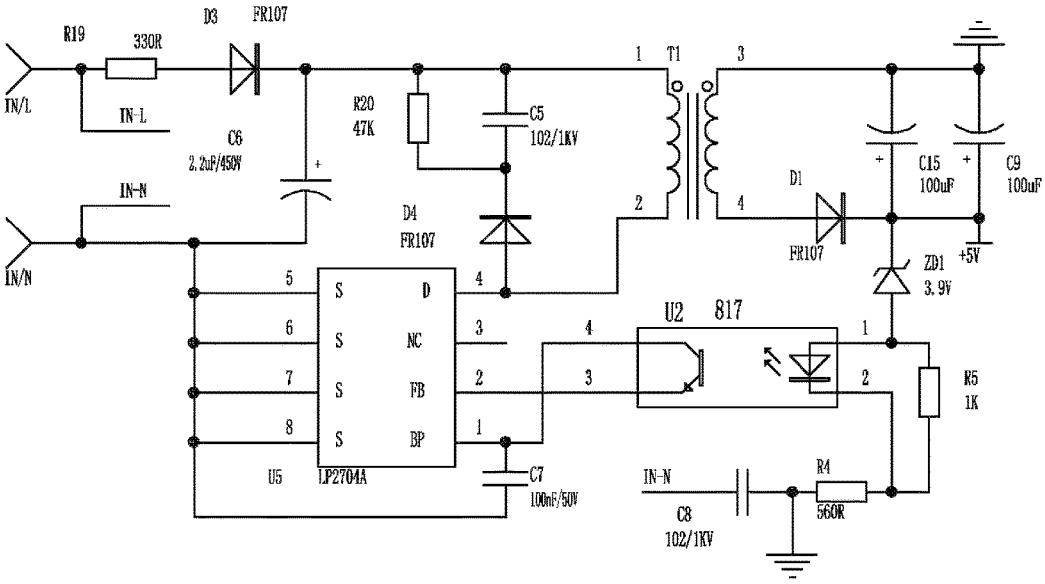
FIG. 12 is a circuit diagram of a power supply module.
Figure 13:
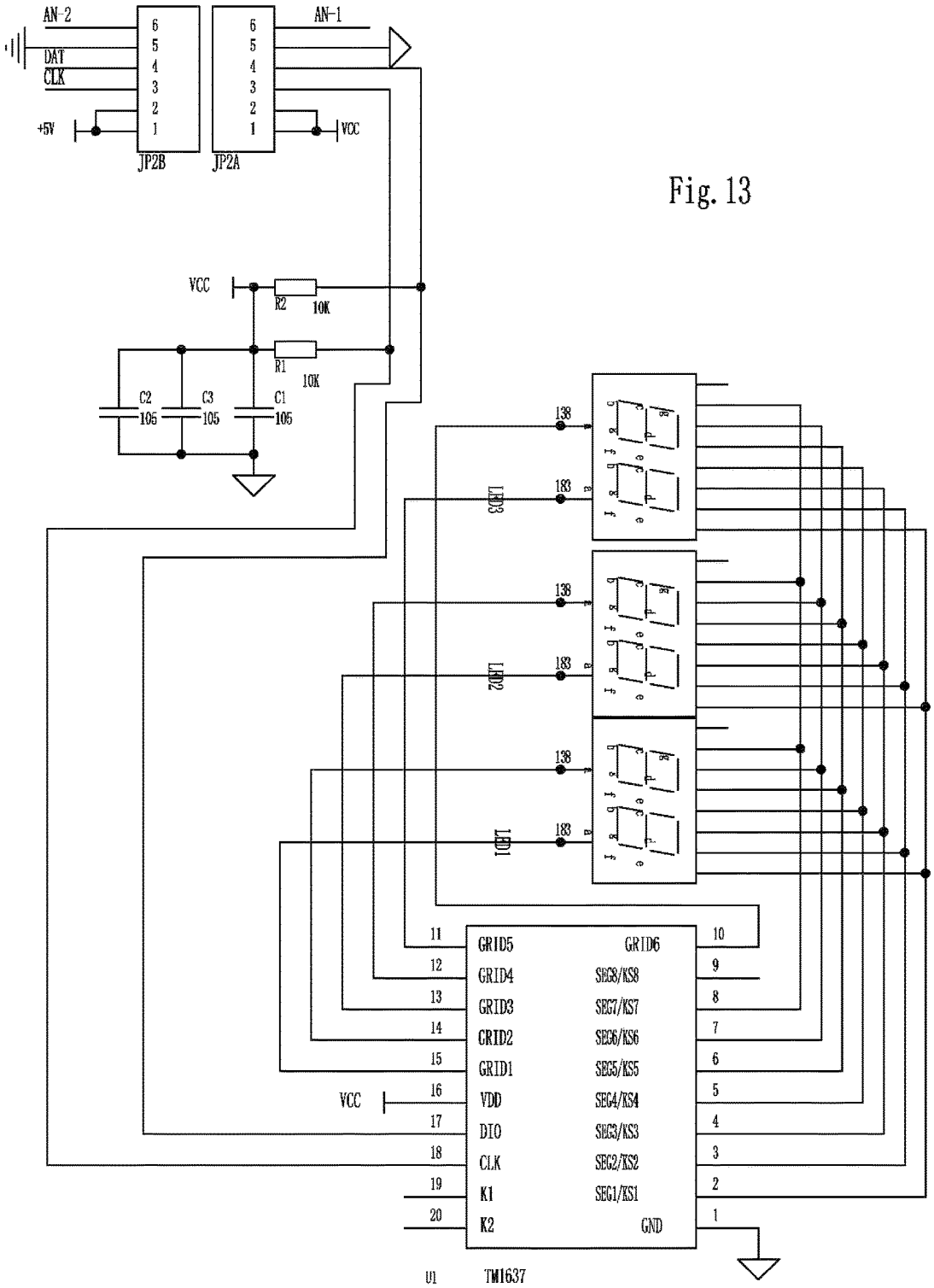
FIG. 13 is a circuit diagram of a display module.

The purpose of introducing the outdoor temperature into calculation is that the outdoor temperature may also exert a great influence on the refrigerating capacity, as shown in the following table 1 derived experimentally and FIG. 6.

| Indoor temperature (° C.) | Fit equation and related parameters |
|---|---|
| 21 | Y = 3038.04762 − 29.00571X, R = −0.99718 |
| 24 | Y = 3126.82571 − 26.07429X, R = −0.99882 |
| 27 | Y = 3507.90476 − 31.90857X, R = −0.98635 |
| 32 | Y = 3128.38095 − 14.36571X, R = −0.91432 |
| average value | Y = 3200.52381 − 25.34286X, R = −0.99205 |

Note:
X is the outdoor temperature, Y is the refrigerating capacity, and R is the refrigerating parameter.

The coefficient of performance R may decrease correspondingly with the increase of the outdoor temperature and the decrease of the indoor temperature, thus the introduction of the indoor temperature and the outdoor temperature into calculation advantageously may improve the accuracy.

As described above, in addition to the current and voltage detection, the temperature detection may be added, which is not just a simple indication of the room temperature, but comprehensively may introduce the sampled current, the sampled voltage, the indoor temperature and the outdoor temperature into factors influencing the predetermined temperature reduction magnitude. Besides, a software algorithm may be combined with a formula for calculating the predetermined temperature reduction magnitude to obtain a true and valid predetermined temperature reduction magnitude which may then be compared to the actual temperature reduction magnitude to determine whether the air conditioner operates normally.

FIGS. 7-13 illustrate the circuit diagrams of the single-chip processor 10, the current detection module 20, the voltage detection module 30, the outdoor temperature detection module 40, the indoor temperature detection module 50, the power supply module 70 and the display module 60, respectively and sequentially. The power supply module 70 may be a switching power supply which comprises a rectifier IC (LP2704), a transformer T1 and an isolation optocoupler U2. The current detection module 20 may use constantan wire R18 as a current detection device and has an operational amplifier for amplification. Since the housing 1 of the air conditioner socket may be limited in size, the constantan wire may be used to detect current instead of a current mutual inductor. Of course, the constantan wire is only one way for performing current detection, and other conventional detection structures are also within the protection scope of the technical scheme. The display module 60 may comprise a display IC (TM1634) and a digital display screen 3. The outdoor temperature detection module 40 and the indoor temperature detection module 50 may use an external thermistor as a temperature sensor to detect the outdoor and indoor temperatures, respectively.

To sum up, the socket may be used to carry out a real-time monitoring without making modification to the software and hardware, and the cost of socket modification is much lower than the cost of modifying the air conditioner itself. After applying the air conditioner socket of the present invention, the user may replace the socket of the air conditioner of a corresponding model him or her, i.e., the monitoring of an installed air conditioner may be accomplished with a minimum cost.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. An intelligent air conditioner socket with abnormality alarm comprising a housing, jacks on the surface of the housing and a conductive component arranged within the housing, characterized in that:

the housing having a single chip processor, a current detection module, a voltage detection module, an outdoor temperature detection module, an indoor temperature detection module, a display module and a power supply module wherein the current detection module, the voltage detection module, the outdoor temperature detection module, the indoor temperature detection module, the display module and the power supply module are electrically connected with the single chip processor respectively, wherein the power supply module is connected with the display module to power it;

the current detection module and the voltage detection module to detect a sampled current and a sampled voltage output to the air conditioner after the power network is connected to the socket respectively, wherein the sampled current and the sampled voltage are fed back to the single-chip processor respectively through an operational amplifier circuit;

the outdoor temperature detection module and the indoor temperature detection module to detect outdoor and indoor temperature signals and feeding the signals back to the single-chip processor;

the single-chip processor is a control and a processing core, the single-chip processor to conduct voltage abnormality detection, current abnormality detection and temperature abnormality detection respectively using the feedback signals;

wherein the voltage abnormality detection comprises comparing a difference between the sampled voltage and a rated voltage with a preset normal voltage difference, if the difference exceeds the preset normal voltage difference, an input voltage of the air conditioner is determined to be overvoltage or undervoltage, and a voltage abnormality alarm signal will be output;

the current abnormality detection comprises comparing a difference between the sampled current and a rated current with a preset normal current difference, if the current difference exceeds the preset normal current difference, an input current of the air conditioners determined to be overcurrent or undercurrent, and a current abnormality alarm signal will be output;

the temperature abnormality detection comprising determining whether a predetermined temperature reduction magnitude is within the range of an actual temperature reduction magnitude*(−120%, +120%) within a time period T.di-elect cons.T.sub.0−Tm, and if not, an abnormality alarm signal will be output; wherein the actual temperature reduction magnitude= F(Tm)−F(T.sub.0), F(T.sub.0) is an initial indoor temperature, and F(Tm) is the indoor temperature at Tm; and the predetermined temperature reduction magnitude=.SIGMA.T.sub.0.about.Tm [voltage T(v)* current T(a)]*nominal energy efficiency ratio (B)/ nominal space area (A)*coefficient of performance R(T)*nominal power factor C, wherein the voltage T(v) and the current T(a) are the sampled voltage and sampled current detected at time T respectively, and the coefficient of performance R(T) is the corresponding coefficient of performance of the outdoor temperature and the indoor temperature at time T; and the display module to display the current temperature, power and abnormality alarm prompts output by the single-chip processor.

2. An intelligent air conditioner socket with abnormality alarm according to claim 1, characterized in that: the single-chip processor prestores a table of values of coefficient of performance at different outdoor temperatures and indoor temperatures directly or indirectly, and reads the value of the coefficient of performance R(T) corresponding to the outdoor temperature and the indoor temperature at time T form the table.

3. An intelligent air conditioner socket with abnormality alarm according to claim 1, characterized in that: the power supply module is a switching power supply which comprises a rectifier IC, a transformer and an isolation optocoupler.

4. An intelligent air conditioner socket with abnormality alarm according to claim 1, characterized in that: the current detection module uses constantan wire as a current detection device.

5. An intelligent air conditioner socket with abnormality alarm according to claim 1, characterized in that: the display module comprises a display IC and a digital display screen.

6. An intelligent air conditioner socket with abnormality alarm according to claim 1, characterized in that: the outdoor temperature detection module and the indoor temperature detection module use an external thermistor as a temperature sensor to detect the outdoor and indoor temperatures, respectively.

* * * * *